US006895699B1

(12) United States Patent
Loeb

(10) Patent No.: US 6,895,699 B1
(45) Date of Patent: May 24, 2005

(54) HEAVY EQUIPMENT SAFETY DEVICE

(76) Inventor: Robert G. Loeb, 3720 E. Mountain View Rd., Phoenix, AZ (US) 85028

( * ) Notice: Subject to any disclaimer, the term of this patent is extended or adjusted under 35 U.S.C. 154(b) by 0 days.

(21) Appl. No.: 10/917,805

(22) Filed: Aug. 13, 2004

Related U.S. Application Data

(62) Division of application No. 10/342,518, filed on Jan. 15, 2003.

(51) Int. Cl.[7] ..... E02F 5/02; G05D 1/02; G05D 1/04

(52) U.S. Cl. ..... 37/348; 37/414; 37/466; 701/50

(58) Field of Search ..... 37/348, 382, 395–397, 37/412–416, 195; 701/50; 172/1, 2, 5; 414/800, 414/815

(56) References Cited

U.S. PATENT DOCUMENTS 5,347,448 A 9/1994 Nam
5,704,429 A 1/1998 Lee et al.
5,822,891 A 10/1998 Fujishima et al.
6,169,948 B1 1/2001 Fujishima et al.
6,170,681 B1 1/2001 Yoshimatsu

*Primary Examiner*—Christopher J. Novosad
(74) *Attorney, Agent, or Firm*—Cahill, von Hellens & Glazer, P.L.C.

(57) ABSTRACT

A backhoe (100) has a hydraulic cylinder (316, 317) with a piston (318, 319) that rotates a rotatable boom (108). A lockable slider block (322) slides on the piston. Movement of the lockable slider block in one direction is caused by a spring (328, 329) mounted around the piston, and in another direction is caused by the telescoping of the piston into the hydraulic cylinder. The backhoe includes a hydraulic valve (340) that controls hydraulic pressure to the hydraulic cylinder and a sensor (320) coupled to the hydraulic valve. Once locked to a position on the piston, the lockable slider block engages the sensor on each occasion the rotatable boom rotates beyond a preselected angle of rotation. Engagement of the sensor causes actuation of the hydraulic valve, thereby preventing further rotation of the boom by the hydraulic cylinder. Alternative embodiments have an encoder (120, 130) that digitizes the position of the boom, and a microcomputer (410) that is programmed to actuate the hydraulic valve.

5 Claims, 4 Drawing Sheets

HEAVY EQUIPMENT SAFETY DEVICE

CROSS REFERENCE TO RELATED APPLICATIONS

This application is a divisional application of an application entitled "HEAVY EQUIPMENT SAFETY DEVICE", filed Jan. 15, 2003 and assigned Ser. No. 10/342,518.

BACKGROUND OF THE INVENTION

1. Field of the Invention

This invention relates to the field of heavy equipment, such as construction or excavating equipment, and in particular to heavy equipment having a rotatable boom, and to programmable means to control rotation of the boom.

2. Description of the Related Art

When heavy equipment, such as a crane or a backhoe, works close to an obstruction, such as a building, wall or fence, there is a risk of operator error causing the heavy equipment to strike and damage the obstruction as the boom of the heavy equipment rotates or extends.

Thus, what is needed is a safety device that overcomes the disadvantages of the prior art by preventing an operator from rotating or extending the boom of the heavy equipment more than a preset amount.

SUMMARY OF THE INVENTION

Briefly described, and in accordance with a preferred embodiment thereof, the present invention relates to an excavating machine having a rotatable boom that includes at least one hydraulic cylinder for controlling rotation of the boom. The hydraulic cylinder includes a piston. The excavating machine also includes a hydraulic valve connected to the at least one hydraulic cylinder. The excavating machine also includes a sensor coupled to the hydraulic valve, and a lockable slider block mounted to the piston. The lockable slider block has a locked state and an unlocked state. The lockable slider block is fixed to a preselected position on the piston when the lockable slider block is in the locked state. The lockable slider block engages the sensor when the piston moves to the preselected position.

The present invention also relates to a method of setting a maximum angle of rotation of a boom of an excavating machine. The rotation of the boom is produced by a hydraulic cylinder having a piston with a lockable slider block on the piston, and the excavating machine has a sensor coupled to a hydraulic valve for controlling hydraulic pressure to the hydraulic cylinder. The method includes the steps of a) rotating the boom to the maximum angle of rotation; b) locking the lockable slider block on the piston when the boom is at the maximum angle of rotation; c) rotating the boom to an angle less than the maximum angle of rotation; and d) causing the lockable slider block to engage the sensor on each occasion that the boom rotates to the maximum angle of rotation again after step a). Engagement of the sensor causes actuation of the hydraulic valve, which prevents further rotation of the boom by the hydraulic cylinder.

The present invention further relates to a method of setting a maximum angle of rotation of a boom of an excavating machine. The rotation of the boom is produced by a hydraulic cylinder. The excavating machine has an encoder for digitizing an angular position of the boom. The encoder is coupled to a hydraulic valve for controlling hydraulic pressure to the hydraulic cylinder. The method includes the steps of: a) pre-rotating the boom to the maximum angle of rotation; b) digitizing the angular position of the boom when the boom is at the maximum angle of rotation in a direction; c) rotating the boom to an angle less than the maximum angle of rotation; and d) generating a signal on each occasion subsequent to step a) that the boom rotates in the direction beyond the maximum desired angle of rotation. The signal causes actuation of the hydraulic valve, which prevents further rotation of the boom in the direction by the hydraulic cylinder.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
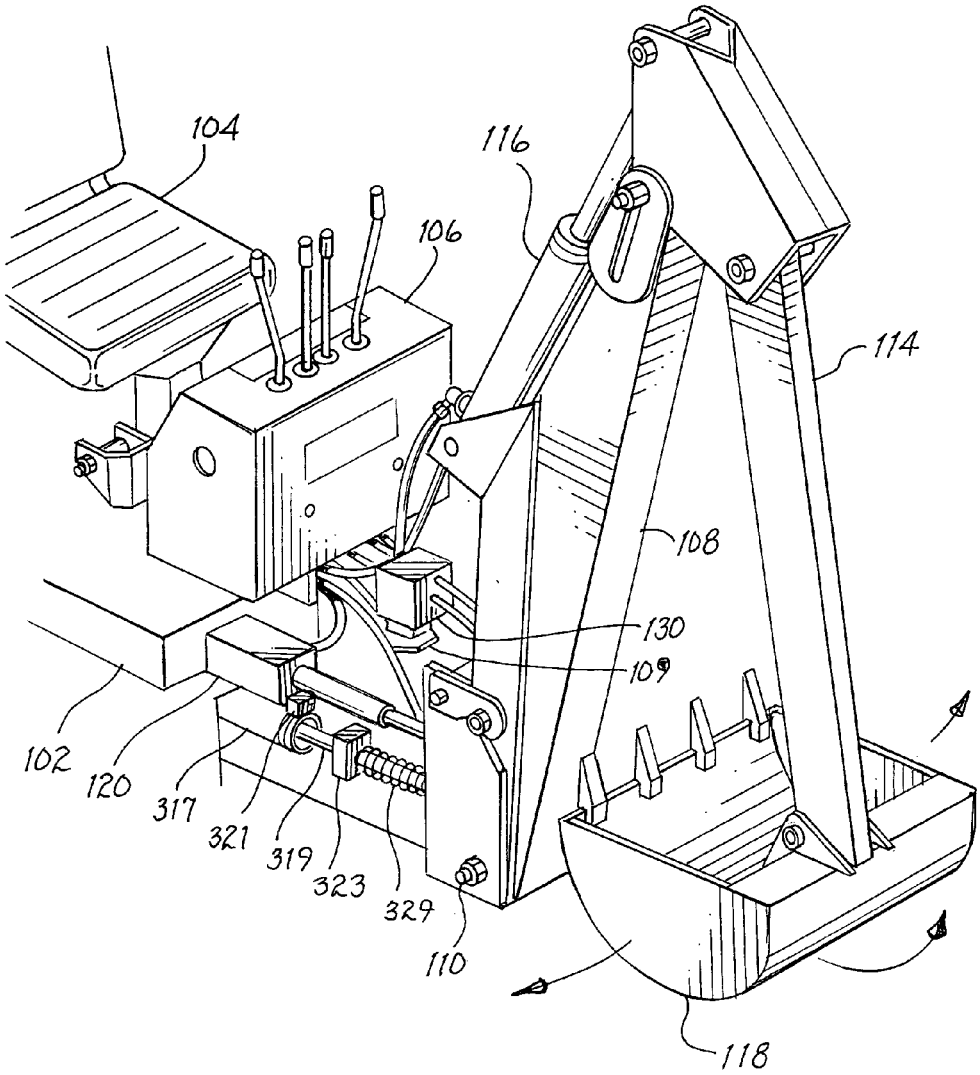
FIG. 1 is a perspective view of a portion of a backhoe.

FIG. 1 is a perspective view of a portion of a backhoe 100. The backhoe 100 has tires or treads (not shown) for movement. The backhoe 100 comprises a frame 102 having a seat 104 for an operator and a control panel 106 for use by the operator. A boom 108 is connected to the frame 102. The boom 108 can rotate vertically about a vertical axis 110. The boom 108 can also rotate horizontally about a horizontal axis 109. Movement of the boom 108 horizontally is produced by a right hydraulic cylinder 317 having one end connected to the frame 102 and another end connected to the boom, and by a left hydraulic cylinder 316 (not shown in FIG. 1) having one end connected to the frame and another end connected to the boom. A stick 114 is hingely connected to the boom 108. Movement of the stick 114 relative to the boom 108 is produced by a stick hydraulic cylinder 116. A bucket 118 is hingely connected to the stick 114. Movement of the bucket 118 relative to the stick 114 is produced by a bucket hydraulic cylinder (not shown). The construction and operation of a backhoe are well known to those skilled in the art.

Figure 2:
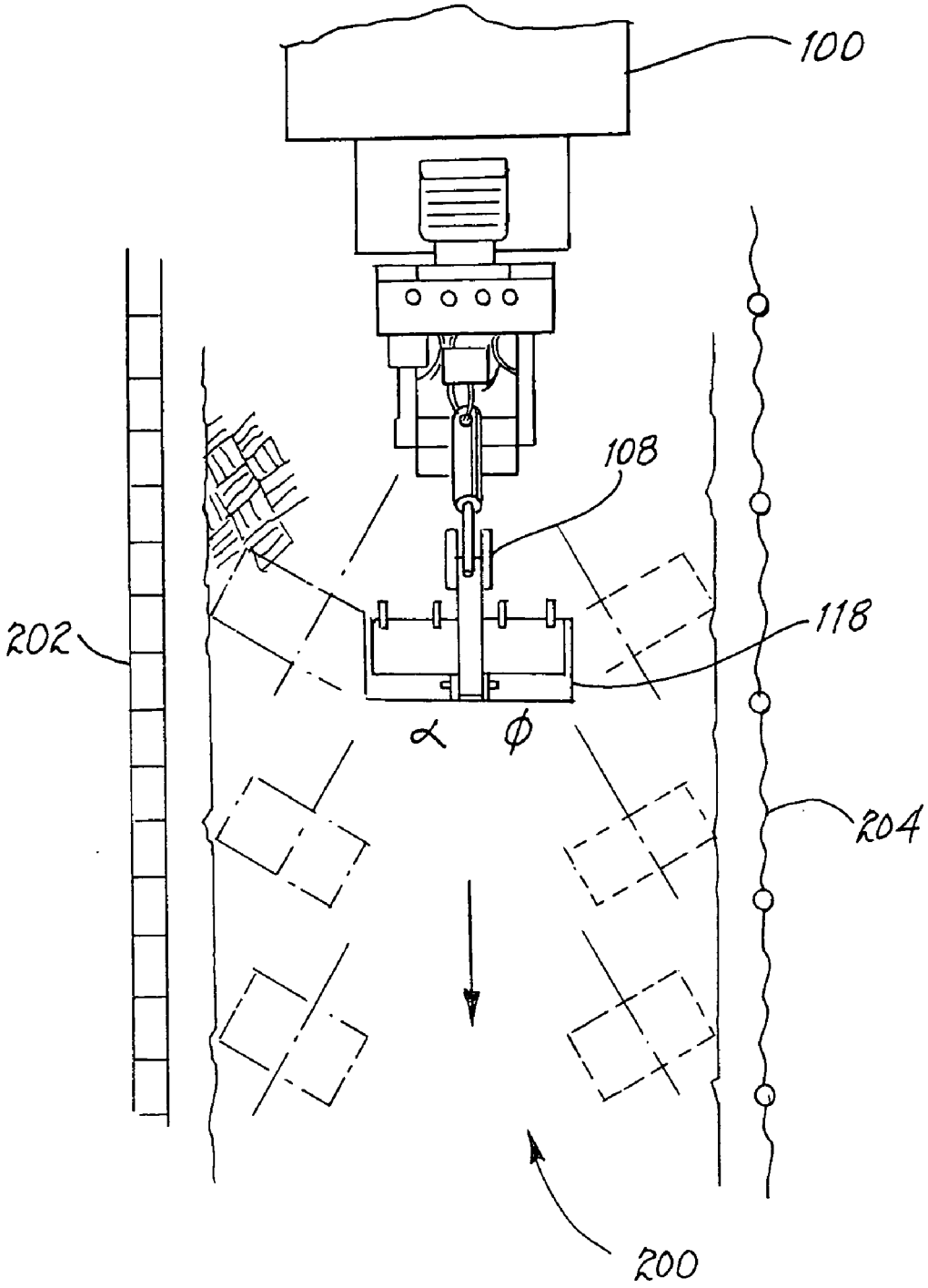
FIG. 2 is a plan view of the backhoe of FIG. 1 showing maximum sideways angles of rotation of the boom of the backhoe while in a confined area.

FIG. 2 is a plan view of the backhoe 100 shown in confined area 200 bordered on one side by a wall 202 and on another side by a fence 204. While in the confined area 200, the maximum sideways angle 206 of rotation of the boom 108 is limited to a degrees to the right and $\phi$ degrees to the left; otherwise, the bucket 118 strikes the wall 202 and the fence 204, respectively, if the operator is not careful.

Figure 3:
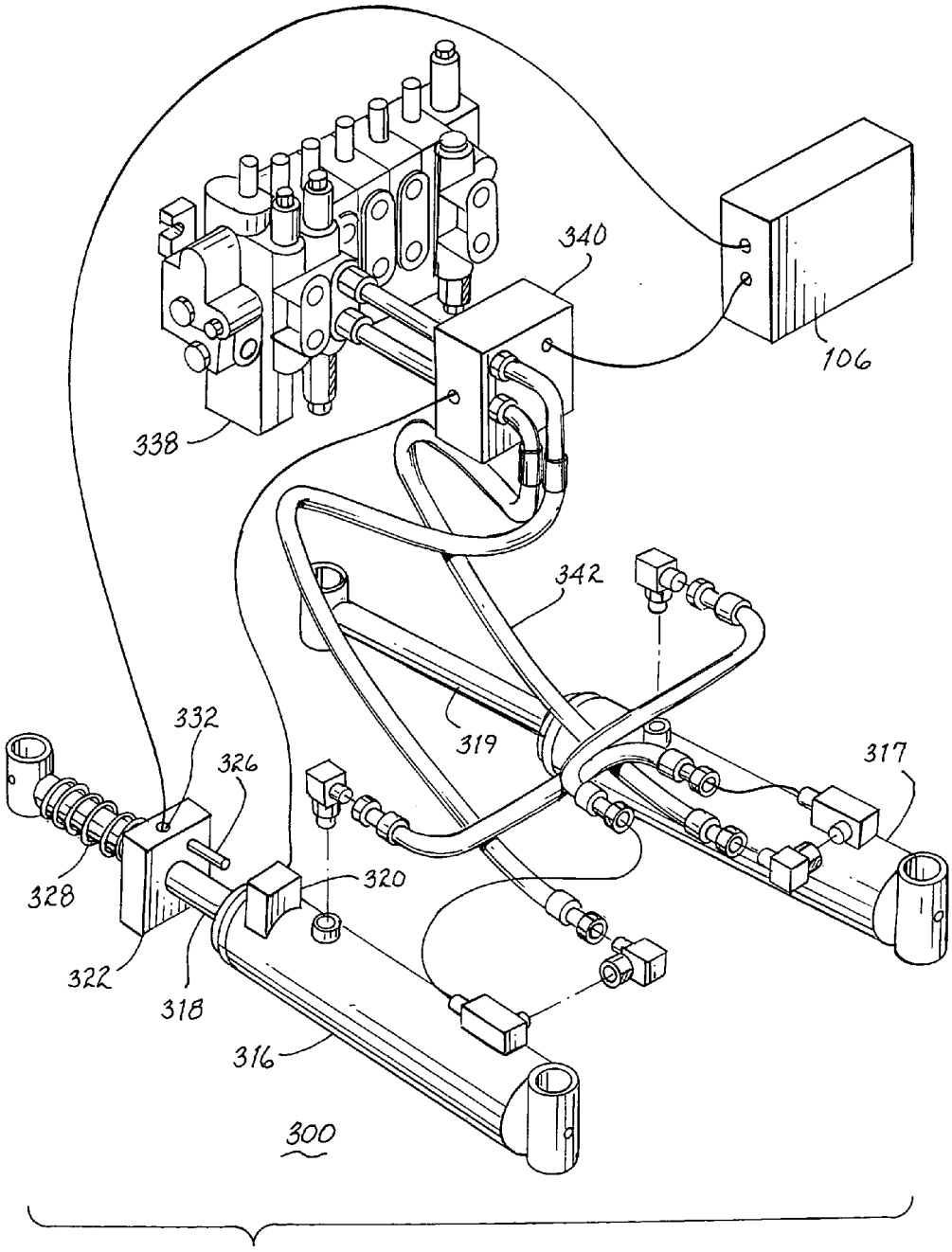
FIG. 3 is a view of a portion of a hydraulic system of the backhoe.

FIG. 3 is a view of a portion of a hydraulic system 300 of the backhoe 100. The hydraulic system 300 comprises the right hydraulic cylinder 317 that includes a right piston 319, and the left hydraulic cylinder 316 that includes a left piston 318. A left lockable slider block 322, including a left protrusion 326, is mounted to the left piston 318. The left lockable slider block 322 is in one of a locked state and an unlocked state. When the left lockable slider block 322 is in the unlocked state, it is free to slide on the left piston 318 along the portion of the left piston that is external to the left hydraulic cylinder 316. A left sensor 320 is mounted to the backhoe near the left hydraulic cylinder 316. A left spring 328 encircles the left piston 318 and applies force on the left lockable slider block 322, thereby tending to move the left lockable slider block in a direction away from the boom 108. The left lockable slider block 322 has a lock 332, such as a set screw, that temporarily fixes the left lockable slider block to a selected position on the left piston 318. The lock 332 is preferably an electromechanical lock and it is electrically coupled to the control panel 106. Alternatively, the lock 322 is a mechanical lock or a hydraulic lock, and it is mechanically or hydraulically coupled to the control panel. When latched, the lock 332 overcomes any force applied on the left lockable slider block by the relatively weak left spring 328. The position at which the left lockable slider block 322 is fixed to the left hydraulic cylinder 316 determines the maximum angle of rotation to the left of the boom 108.

Prior to being fixed to the selected position on the left piston 318, the left lockable slider block 322 is forced against the left hydraulic cylinder 316 by the left spring 328. The operator then turns the boom 108 to the left to a maximum desired amount, thereby causing the left piston 318 to telescope into the left hydraulic cylinder 316. Because the left lockable slider block 322 is free to move on the left piston 318, when the left piston telescopes into the left hydraulic cylinder, the left lockable slider block effectively moves to a position on the left piston 318 that is closer to the boom 108. Prior to locking the left lockable slider block 322, if the operator rotated the boom 108 too much to the left, the operator simply moves the boom a little to the right, and the left spring 328 moves the left lockable slider block to a position on the left piston 318 farther from the boom. In other words, the left lockable slider block 322 is movable to any position on the left piston external to the left hydraulic cylinder 316. Movement of the left lockable slider block 322 away from the boom 108 is caused by the left spring 328. Movement of the left lockable slider block 322 toward the boom 108 is caused by the left piston 318 telescoping into the left hydraulic cylinder 316, which occurs when the boom turns to the left.

The hydraulic system 300 includes a set of spool valves 338 that are connected to the right hydraulic cylinder 317, the left hydraulic cylinder 316, the stick hydraulic cylinder 116 and the bucket hydraulic cylinder, and to hydraulic controls (not shown) that are near the seat 104 for the operator. A hydraulic valve 340, which further controls hydraulic pressure to the left and right hydraulic cylinders 316, 317, is connected to the set of spool valves 338. The hydraulic valve 340 is hydraulically connected to the right hydraulic cylinder 317 and the left hydraulic cylinder 316 via a set of hydraulic hoses 342. Preferably, the hydraulic valve 340 is an electromechanical hydraulic valve and includes a solenoid, and the hydraulic valve is electrically coupled to the left sensor 320 and to the control panel 106. Once the left lockable slider block 322 is locked into the preselected position by the operator, an electrical signal from the left sensor 320 actuates the hydraulic valve 340 that cuts off hydraulic pressure to the left hydraulic cylinder 316, thereby preventing further rotation of the boom 108. Alternatively, the hydraulic valve 340 is a mechanical hydraulic valve, and through a mechanical or hydraulic connection with the left sensor 320, the left sensor actuates the hydraulic valve.

Referring again to FIG. 1, a right sensor 321 including a right protrusion, is mounted to the backhoe near the right hydraulic cylinder 317. A right lockable slider block 323 is mounted to the right piston 319. The position at which the right lockable slider block 323 is fixed to the right piston 319 determines the maximum angle of rotation to the right of the boom 108. The right sensor 321 is mounted to the backhoe near the right hydraulic cylinder 317. A right spring 329 encircles the right piston 319. The right sensor 321, the right hydraulic cylinder 317, the right lockable slider block 323, the right sensor 321 and the right spring 329 operate in a similar manner to the corresponding left components, and therefore will not be described in detail.

In a second embodiment, a linear encoder 120 is mounted to the frame 102. The linear encoder 120 includes a telescoping portion 122 that telescopes in response to the rotational position of the boom 108 relative to the frame 102. The linear encoder 120 digitizes the linear position of the telescoping portion 122. In a third embodiment, a rotary encoder 130 is mounted at the horizontal axis 109 of the boom 108, and the rotary encoder digitizes the angular position of the boom relative to the frame 102. In the second and third embodiments, one of the linear encoder 120 and the rotary encoder 130 replaces the left and right lockable slider blocks 322, 323, the left and right sensors 320, 321 and the left and right springs 328, 329 of the first embodiment.

Figure 4:
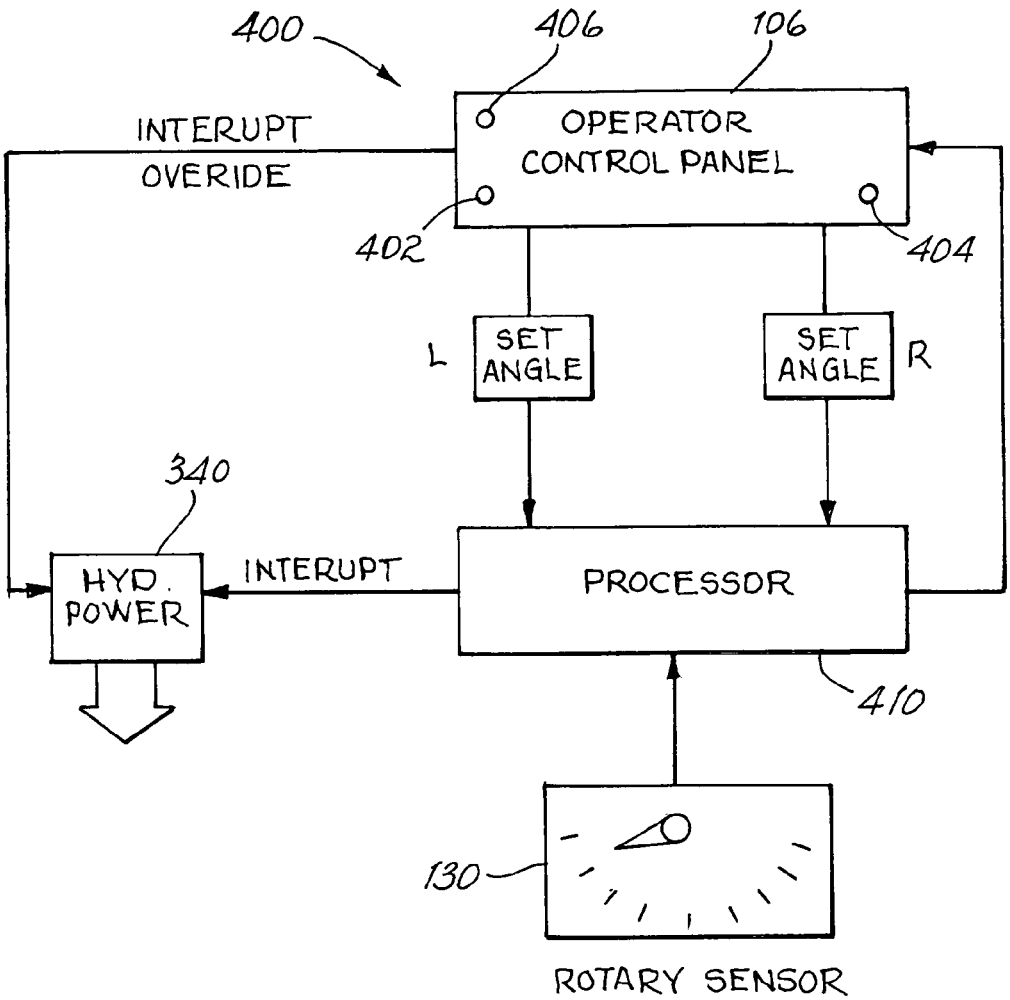
FIG. 4 is a functional block diagram of a control system in accordance with the invention.

The functional block diagram of a control system 400 in accordance with the third embodiment of the invention shown in FIG. 4 comprises a control panel 106 that includes a left limit button 402, a right limit button 404 and a light 406. The control system 400 also comprises a microcomputer 410 coupled to the left limit button 402, the right limit button 404 and the light 406. The microcomputer 410 is also coupled to the hydraulic valve 340 and to the rotary encoder 130 (and alternatively to the linear encoder 120.) Upon the left limit button 402 being depressed by the operator, the microcomputer 410 queries the rotary encoder 130 as to the current rotational position of the boom 108 relative to the frame 102. A digitized value of the degrees of rotation of the boom 108 relative to the frame 102 is then stored in a memory of the microcomputer 410 as a preselected maximum desired angle of rotation to the left. The microcomputer 410 continually receives signals from the rotary encoder 130, which convey digitized values of the rotational position of the boom 108 relative to the frame 102. The microcomputer 410 is programmed to generate a signal that actuates hydraulic valve 340 any time the digitized value of the current rotational position is greater than or equal to the digitized maximum desired angle of rotation to the left.

The first embodiment of the invention has a control system (not shown) that is coupled to the left and right sensors 320, 321 and to the left and right lockable slider blocks 322, 323, instead of to the linear encoder 120 or the rotary encoder 130. A microcomputer is not required in the control system for the first embodiment.

With the first embodiment, a method of setting a maximum desired angle of rotation of the boom 108 to the left includes the steps of: a) pre-rotating the boom to the maximum desired angle of rotation of $\phi$ degrees to the left; b) locking the left lockable slider block 322 on the left piston 318 when the boom is at the maximum desired angle of rotation to the left by depressing the left limit button 402 on the control panel, thereby setting a setpoint; c) operating the backhoe in a normally intended fashion, which begins with rotating the boom to an angle less than the maximum desired angle of rotation to the left, i.e., rotating the boom to the right, as the boom was at the maximum desired angle of rotation to the left in the preceding step; d) causing the lockable slider block to engage the left sensor 320 on each occasion that the boom rotates to the maximum desired angle of rotation subsequent to step a). Engagement of the sensor illuminates a light 406 on the control panel and actuates the hydraulic valve 340, which prevents further rotation of the boom to the left by the left hydraulic cylinder 316. A method of setting a maximum desired angle of rotation of the boom 108 at $\alpha$ degrees the right is substantially similar to the method of setting a maximum desired angle of rotation of the boom 108 at $\phi$ degrees to the left; therefore, the method will not be described in detail.

With the third embodiment using the microcomputer 410 and the rotary encoder 130, the method of setting a maximum desired angle of rotation of the boom 108 to the left includes the steps of: a) pre-rotating the boom to the maximum desired angle of rotation of $\phi$ degrees to the left, and depressing the left limit button 402 on the control panel, thereby setting a setpoint; b) digitizing the angular position of the boom when the boom is at the maximum desired angle of rotation to the left; c) operating the backhoe in a normally intended fashion, which begins with rotating the boom to an angle less than the maximum desired angle of rotation to the left, i.e., rotating the boom to the right, as the boom was at the maximum desired angle of rotation to the left in the preceding step; d) generating a signal on each occasion that the boom rotates to the maximum desired angle of rotation subsequent to step a), whereby the signal causes actuation of the hydraulic valve 340 which prevents further rotation of the boom to the left by the left hydraulic cylinder 316. A method of setting a maximum desired angle of rotation of the boom 108 at a degrees the right is substantially similar to the method of setting a maximum desired angle of rotation of the boom 108 at $\phi$ degrees to the left; therefore, the method will not be described in detail.

The method of setting a maximum desired angle of rotation of the boom 108 with the second embodiment using the microcomputer 410 and the linear encoder 120, is substantially similar to the method of setting a maximum desired angle of rotation of the boom with the third embodiment using the microcomputer 410 and the rotary encoder 130; therefore, the method will not be described in detail.

The methods of extending the boom, or rotating the boom in a vertical plane, are substantially similar to the methods of rotating the boom in a horizontal plane; therefore, the methods will not be described in detail.

The safety device in accordance with the invention allows the operator to rotate and extend the boom 108 to a point as near to the obstruction as the operator wants to work and then store that setpoint. Thereafter, if the operator should inadvertently try to rotate and/or extend the boom 108 beyond that setpoint, the device provides a safety stop to prevent travel beyond that point, thereby preventing accidental damage.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims. For example, the excavating equipment safety device can comprise a heavy mechanical stop lockable into the rotating mechanism to stop the travel. The excavating equipment safety device can comprise a hydraulic release lever attached to the safety stop so the hydraulic drive pressure is bypassed to stop the boom rotation at setpoints. The excavating equipment safety device can comprise an electronic switch or an optical sensor, attached at the proper setpoint, to electronically open a hydraulic bypass valve to release the hydraulic pressure and stop the boom rotation.

I claim:

1. A method of setting a maximum angle of rotation of a boom of an excavating machine, the rotation of the boom produced by a hydraulic cylinder having a piston with a lockable slider block on the piston, the excavating machine having a sensor coupled to a hydraulic valve for controlling hydraulic pressure to the hydraulic cylinder, comprising the steps of:

(a) pre-rotating the boom to the maximum angle of rotation;

(b) locking the lockable slider block on the piston when the boom is at the maximum angle of rotation in a direction;

(c) rotating the boom to an angle less than the maximum angle of rotation; and (d) causing the lockable slider block to engage the sensor on each occasion that the boom rotates in the direction to the maximum angle of rotation again after step (a), whereby engagement of the sensor causes actuation of the hydraulic valve which prevents further rotation of the boom by the hydraulic cylinder.

2. The method of claim 1 in which the excavating machine includes a spring mounted around the piston, and in which the spring moves the lockable slider block to a position on the piston as the boom rotates to the maximum angle of rotation while the lockable slider block is in an unlocked state.

3. The method of claim 2 in which step (a) includes, after pre-rotating the boom to the maximum angle of rotation in a direction, the step of rotating the boom to an angle less than the maximum angle of rotation, thereby causing the spring to move the lockable slider block to another position on the piston.

4. The excavating machine of claim 1, in which the boom rotates in a substantially horizontal plane.

5. The excavating machine of claim 1, in which the boom rotates in a substantially vertical plane.

* * * * *